US009962057B2

(12) United States Patent
Dingert et al.

(10) Patent No.: US 9,962,057 B2
(45) Date of Patent: May 8, 2018

(54) CLEANING APPARATUS WITH A FLUID CONTAINER

(71) Applicant: CARL FREUDENBERG KG, Weinheim (DE)

(72) Inventors: Uwe Dingert, Absteinach (DE); Norbert Weis, Weinheim (DE); Mike Kosub, Bruchsal (DE); Tomaso Cascione, Milan (IT)

(73) Assignee: Carl Freudenberg KG, Weinheim (DE)

( * ) Notice: Subject to any disclaimer, the term of this patent is extended or adjusted under 35 U.S.C. 154(b) by 0 days. days.

(21) Appl. No.: 14/651,675

(22) PCT Filed: Sep. 26, 2013

(86) PCT No.: PCT/EP2013/002884

§ 371 (c)(1),
(2) Date: Jun. 12, 2015

(87) PCT Pub. No.: WO2014/090350

PCT Pub. Date: Jun. 19, 2014

(65) Prior Publication Data

US 2015/0305588 A1 Oct. 29, 2015

(30) Foreign Application Priority Data

Dec. 13, 2012 (DE) ..... 10 2012 024 356
Aug. 26, 2013 (DE) ..... 10 2013 014 024

(51) Int. Cl.
*A47L 13/22* (2006.01)
*A47L 13/16* (2006.01)
*A47L 13/26* (2006.01)

(52) U.S. Cl.
CPC ..... *A47L 13/225* (2013.01); *A47L 13/16* (2013.01); *A47L 13/22* (2013.01); *A47L 13/26* (2013.01); *A47L 2201/02* (2013.01)

(58) Field of Classification Search
CPC ..... A47L 12/225; A47L 13/16; A47L 13/26; A47L 2201/22
See application file for complete search history.

(56) References Cited

U.S. PATENT DOCUMENTS 5,920,952 A * 7/1999 Baldacci ..... A47L 11/34 15/320
6,131,237 A 10/2000 Kasper et al.
(Continued)

FOREIGN PATENT DOCUMENTS

CN 101123909 A 2/2008
CN 201263661 Y 7/2009
(Continued)

*Primary Examiner* — Dung Van Nguyen
(74) *Attorney, Agent, or Firm* — Leydig, Voit & Mayer, Ltd.

(57) ABSTRACT

A cleaning apparatus for cleaning floors and/or surfaces, having a container for holding a cleaning fluid, a discharge device for discharging the cleaning fluid onto a floor and/or surface to be cleaned, and a heating device for heating and/or tempering and/or evaporating the cleaning fluid. The cleaning apparatus can easily be supplied with energy for heating and/or tempering and/or evaporating the cleaning fluid, and the apparatus can be operated cordlessly.

37 Claims, 7 Drawing Sheets

(56) References Cited

U.S. PATENT DOCUMENTS 6,571,421 B1 * 6/2003 Sham ..... A47L 5/28 15/320
6,584,990 B2 * 7/2003 Shaw ..... A47L 13/225 134/105
7,699,551 B2 * 4/2010 Suda ..... A47L 13/22 401/138
7,774,894 B2 * 8/2010 Rippl ..... A47L 11/34 15/118
7,811,022 B2 * 10/2010 Bobrosky ..... A47L 9/04 15/209.1
7,930,798 B2 * 4/2011 Zhou ..... A47L 11/34 15/320
2002/0176735 A1 11/2002 Dingert et al.
2003/0089383 A1 5/2003 Biggs
2006/0185113 A1 8/2006 Kloeppel et al.
2007/0130718 A1 * 6/2007 Chung ..... A47L 11/34 15/320
2007/0212035 A1 9/2007 Oh
2007/0231046 A1 10/2007 Whiffen et al.
2007/0267049 A1 * 11/2007 Righetto ..... A47L 7/0009 134/34
2009/0313767 A1 12/2009 Tanner et al.
2010/0126533 A1 * 5/2010 Nottingham ..... A47L 13/22 134/105
2012/0145191 A1 * 6/2012 Williams ..... A47L 13/17 134/6
2012/0204376 A1 * 8/2012 Charlton ..... A47L 13/225 15/322
2012/0255140 A1 10/2012 Tomita et al.
2013/0091647 A1 * 4/2013 Yuan ..... A47L 13/225 15/98
2013/0318725 A1 * 12/2013 Kellis ..... A47L 13/225 8/137
2014/0041147 A1 * 2/2014 Pagoria ..... A47L 11/4083 15/322
2014/0075710 A1 * 3/2014 Hansen ..... A47L 13/17 15/320

FOREIGN PATENT DOCUMENTS

CN 201324218 Y 10/2009
CN 201996475 U 10/2011
CN 202235207 U 5/2012
DE 10124336 B4 2/2003
EP 1795108 A2 6/2007
EP 2279686 A2 2/2011
WO WO 2007046889 A1 4/2007
WO WO 2007047792 A2 4/2007
WO WO 2008007830 A1 1/2008
WO WO 2009132317 A1 10/2009
WO WO 2009148911 A1 12/2009

* cited by examiner

CLEANING APPARATUS WITH A FLUID CONTAINER

CROSS-REFERENCE TO RELATED APPLICATIONS

This application is a U.S. national stage application under 35 U.S.C. § 371 of International Application No. PCT/EP2013/002884, filed on Sep. 26, 2013, and claims benefit to German Patent Application No. DE 10 2012 024 356.1, filed on Dec. 13, 2012, and German Patent Application No. DE 10 2013 014 024.2, filed on Aug. 26, 2013. The International application was published in German on Jun. 19, 2014, as WO 2014/090350 A2 under PCT Article 21(2).

FIELD

The invention relates to a cleaning apparatus configured to clean a floor and/or a surface.

BACKGROUND

Cleaning apparatuses for cleaning floors and/or surfaces that comprise a container for holding a cleaning fluid are already known from the prior art, for example DE 101 24 336 B4. The cleaning fluid is transferred via a discharge device onto a floor and/or a surface to be cleaned.

Such a discharge device can be embodied as a nozzle or can comprise a sponge or a cloth, which transfers cleaning fluid onto the floor and/or the surface by capillary forces.

The cleaning apparatuses known from the prior art require an external power source in order to heat and/or control the temperature of the cleaning fluid within the container. A cable is often provided, which is connected to the external power source. However, the handling of such cleaning apparatuses is uncomfortable and complex.

SUMMARY

An aspect of the invention provides a cleaning apparatus configured to clean a floor, surface, or both, the apparatus comprising: a container configured to hold a cleaning fluid; a discharge device configured to discharge the cleaning fluid onto a floor, a surface, or a floor and a surface to be cleaned; and a heating device configured for heating, temperature control, vaporization, or a combination thereof, of the cleaning fluid, wherein the cleaning apparatus can be operated cordlessly.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
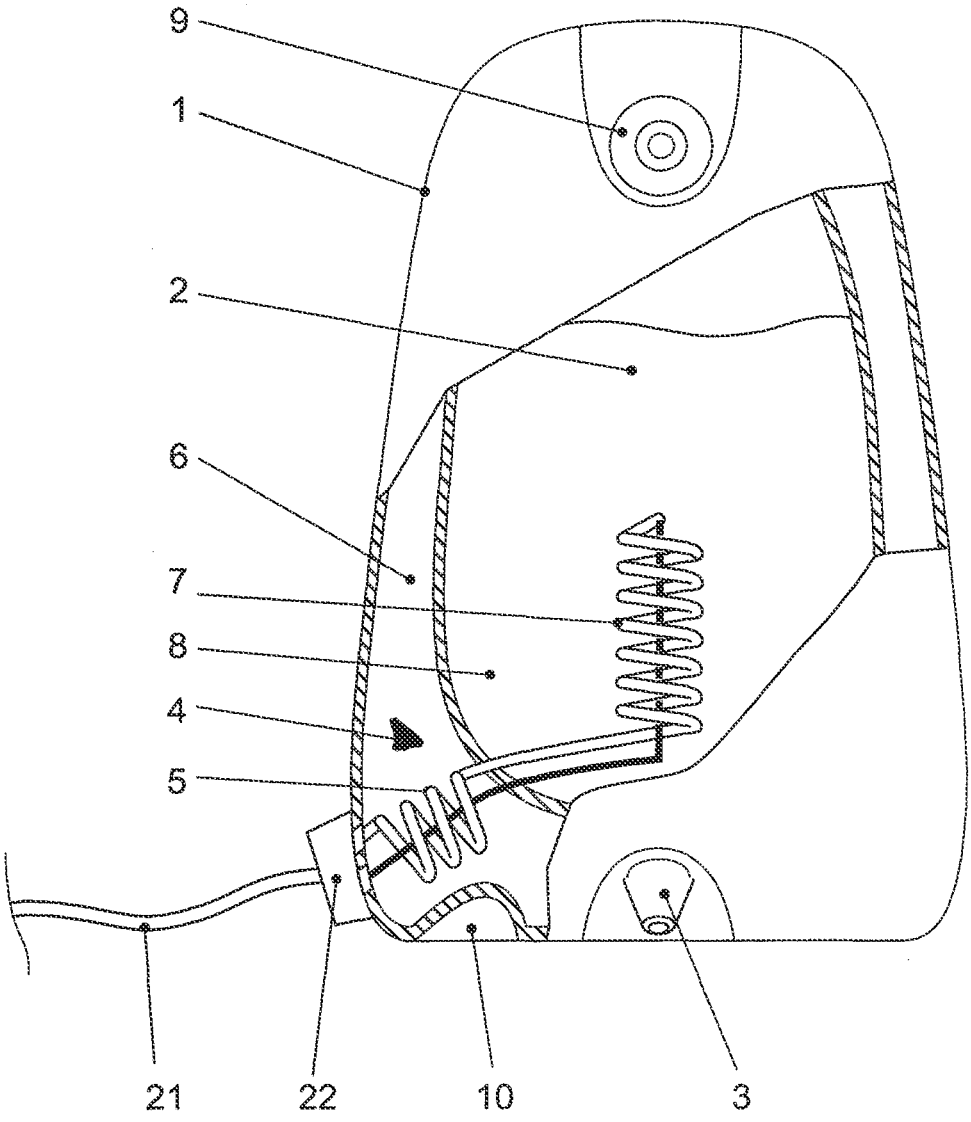
FIG. 1 shows a schematic view of a container which is assigned a heat store, of which the temperature can be controlled by a heating coil.

An aspect of the invention provides a cleaning apparatus of the type mentioned in the introduction in such a way that this cleaning apparatus can be supplied without difficulty with energy for the heating and/or temperature control and/or vaporization of the cleaning fluid.

In accordance with the invention it has been found that the energy of an external power source can be fed to the heating device during a charging period, wherein the cleaning apparatus itself can be decoupled from the external power source during a cleaning process. The cleaning apparatus can thus be operated cordlessly in accordance with the invention. In this respect a cleaning apparatus is embodied in such a way that it can be supplied without difficulty with energy for the heating and/or temperature control and/or vaporization of the cleaning fluid.

The problem mentioned in the introduction is solved as a result.

The heating device could be assigned a heat store, which holds the cleaning fluid alone or jointly with the heating device at a predefinable operating temperature. A heat store can deliver heat to the cleaning fluid over a relatively long period of time and can then also hold said cleaning fluid at a suitable operating temperature if an external power source is no longer available. The heat store ensures that heat is delivered to the cleaning fluid in a defined manner over a very long period of time, such that said cleaning fluid can be delivered in a hot or warm state onto a floor and/or a surface to be cleaned.

The heating device could heat the cleaning fluid to an operating temperature that is greater than 10° C., but below 100° C. As a result of this specific embodiment it is ensured that no high pressures caused by steam production are formed within the container. A temperature at which steam production does not yet take place is preferably maintained. Hot cleaning fluid can thus indeed be delivered to floors or surfaces to be cleaned, however it is still ensured that high internal pressures, which could damage the container, do not form within the container. In this regard, the boiling point of the cleaning fluid is not reached, so as to avoid steam production.

In a preferred embodiment the heating device could heat the cleaning fluid to an operating temperature that is greater than 100° C. As a result of produced steam, a high energy can advantageously be applied to the surface to be cleaned. The discharge device can be embodied in a very simple manner in terms of structure, for example in the form of a valve. With this specific embodiment the boiling point of the cleaning fluid is reached, so as to bring about steam production.

The heating device could be embodied as an electrical resistance heater. Known technology less susceptible to failure is advantageously used for heat production.

The heating device could switch off automatically once a predefined operating temperature of the cleaning fluid has been reached. On this basis, it is conceivable that the heating device switches off automatically at an operating temperature defined by the manufacturer. This can be effected by a thermostat.

The heating device and/or the heat store could be operable cordlessly. As a result of this specific embodiment the cleaning apparatus can be moved and used independently of an external power source.

On this basis the heating device could be operable by a battery. A battery can be charged by an external power source during a charging period. Once the battery has been charged, this can provide energy over a very long period of time, with which energy cleaning fluid is heated and/or the temperature of cleaning fluid is controlled.

The battery could be chargeable by a charging apparatus, which is held either in or on the cleaning apparatus or in or on an external charging station. The battery advantageously can be quickly charged using a charging apparatus.

Both the charging apparatus and the heating device and/or the heat store and/or the cleaning fluid could be capable of being acted on simultaneously with energy. The user can advantageously bring the cleaning apparatus into a state ready for operation in a time-saving and self-explanatory manner.

The heating device could be operable by a mains voltage. A very high heating power can thus be fed without difficulty. Current from the power socket can be used without difficulty. A cable can thus be used only for a certain period of time, specifically in order to thermally charge the cleaning fluid and/or the heat store. The cable can then be separated from the mains supply and/or from the cleaning apparatus.

The heating device could be operated by liquid, solid and/or gaseous fuels. Gas, petrol, oil, fire-lighter gel, alcohol, coal, wood and the like could be used as such fuels. These fuels advantageously have a high energy content. Furthermore, with use of these fuels the cleaning apparatus can be used in a mobile manner without difficulty.

The heat store could comprise phase change materials, or what are known as PCMs. An example for such material is paraffin. These materials demonstrate a particularly high heat storage capacity. In the event of a phase transition from solid to fluid, these materials demonstrate defined temperature ranges in which heat can be fed, without the temperature of the materials changing. When cooling such material, said material delivers the stored heat to the surrounding environment. This effect can be used in order to feed the stored heat to the cleaning fluid and thus compensate for the cooling thereof to ambient temperature over a certain period of time.

The heat store could comprise steel, zinc, aluminum, sugar or tin. These materials have a high heat storage capacity.

In a preferred exemplary embodiment the heat store could be surrounded at least in part by the container. The heat from the heat store can thus be delivered in all directions to the cleaning fluid.

The heat store could be in contact with the container. By way of example, the heat store may rest only against one side of the container. The heat store can advantageously be easily mounted and exchanged. The container is preferably insulated.

The container could be removable from the cleaning apparatus. As a result of this specific embodiment the container can be filled with cleaning fluid and then coupled again to the cleaning apparatus.

The heating device and/or the heat store could be removable from the cleaning apparatus. The heat store can thus be thermally charged separately from the cleaning apparatus.

The heating device and/or the heat store could be integrated into the container. Due to this specific embodiment the heating device and/or the heat store can be removed from the cleaning apparatus jointly with the container.

Both the heating device and the heat store could be connected to an external power source. Following a charging process the container can be filled with cleaning fluid. On this basis it is also conceivable that the container is firstly filled with cleaning fluid and the cleaning fluid is then heated. The container with heated cleaning fluid can then be coupled to the cleaning apparatus. The cleaning fluid is then heated further by the heating device and/or the heat store, independently of an external power source, or is held in a desired operating temperature range.

The cleaning apparatus could be separable from a charging station. The charging station enables a simple connection of the heating device to a power source. On this basis it is conceivable that the charging station connects the heating device to the mains voltage of a power network. As soon as the heating device and/or the heat store and/or the cleaning fluid are thermally charged, the cleaning apparatus can be removed from the charging station and used cordlessly for cleaning in a mobile manner. In the simplest case the charging station is embodied as a separable power cable. On this basis it is conceivable for an adapter for the power cable to be provided on the cleaning apparatus.

The discharge device could be thermally insulated with respect to the surrounding environment. The temperature of the cleaning fluid is thus advantageously prevented from falling to an undesirable extent.

On this basis the discharge device could be heatable. By heating, the cleaning fluid can be held at a desired temperature.

The discharge device could be mechanically, pneumatically, hydraulically and/or electrically operable. On this basis it is conceivable to use pumps, $CO_2$ cartridges or pressure containers. It is also conceivable to use the force of gravity in order to convey the cleaning fluid onto the surfaces to be cleaned. Ultrasound could be used to convey the cleaning fluid. In addition, ultrasound could be used in order to finely atomize the cleaning fluid or in order to disperse the cleaning fluid in droplets.

The discharge device could be operated by an actuation device comprising a handle. The handle preferably cooperates with a rod, which actuates the discharge device.

The container for holding the cleaning fluid could be formed as a thermally insulated fluid tank. The cleaning fluid is thus held as long as possible at the operating temperature.

The cleaning apparatus could comprise a frame, wherein an opening is provided in the frame, through which opening the discharge device applies cleaning fluid to the floor to be cleaned and/or the surface to be cleaned. A textile can be stretched by the frame in order to receive or to distribute the cleaning fluid.

The cleaning apparatus could comprise a display device, which indicates that an operating temperature of the cleaning fluid has been reached. The operating person can thus easily be advised that the cleaning apparatus is ready for use. The display device could generate optical or acoustic signals.

The display device could be formed as a whistle. A whistle generates a loud, easily audible signal in the manner of a kettle.

The whistle could be arranged in the vicinity of the discharge device. It is thus ensured that escaping fluid or steam does not injure the user.

The cleaning apparatus could comprise a fill level indicator, which indicates the quantity of cleaning fluid still available. The operating person can thus easily identify whether the cleaning apparatus is ready for use.

The cleaning apparatus could comprise a reheater element, which is assigned to the heating device or the discharge device in order to vaporize the cleaning fluid. The cleaning fluid in the fluid tank can thus be brought to a first temperature and can be brought to the final temperature and vaporized only just before exit from the discharge device. Energy can thus be saved. By way of example, an instantaneous heater can be used as reheater element.

The cleaning apparatus could comprise a metering device, which adds a substance to the cleaning fluid. As a result of this measure, temperature-sensitive cleaning agents or disinfectants can be mixed with the cleaning fluid just before exit thereof from the discharge device. The metering device is preferably positioned between the discharge device and fluid tank, but always after the fluid tank in the flow direction.

The cleaning apparatus is preferably embodied as a mop. A mop can be equipped with sponges, textiles and/or nozzles, which feed the cleaning fluid from the container to the floor and/or the surface to be cleaned.

The cleaning apparatus could be an autonomous cleaning robot. Such a robot can move independently on surfaces to be cleaned and can clean these surfaces.

The cleaning fluid of the cleaning robot could be heated at a docking station. Furthermore, an accumulator of the cleaning robot can be charged at the docking station and controls the temperature of or vaporizes the cleaning fluid as the cleaning robot moves. The cleaning robot preferably produces steam as it moves. As soon as the accumulator is empty, the cleaning robot returns to the docking station in order to be charged. On this basis, it is also conceivable that the cleaning robot at the docking station receives hot cleaning fluid from a stationary reservoir.

A cloth for use on a cleaning apparatus of the type described here could comprise a planar main body, in which a hole is formed. The cloth can be stretched on a frame, wherein an opening is provided in the frame, through which opening the discharge device applies cleaning fluid to the floor to be cleaned and/or the surface to be cleaned. Since a hole, which is largely aligned with the opening in the frame, is also provided in the cloth, the cleaning fluid can be applied directly to the floor to be cleaned and/or the surface to be cleaned and can be distributed using the cloth. Furthermore, an abrasive effect can be exerted on stubborn dirt using the cloth.

Furthermore, the hole in the textile main body could be covered with a flexible net-like structure. Cleaning fluid can thus be applied to the floor to be cleaned and at the same time an abrasive cleaning action can be exerted by the net-like structure.

The cloth can also be fabricated without hole.

FIG. 1 shows a container 1 for holding a cleaning fluid 2, which can be assigned to a cleaning apparatus for cleaning floors and/or surfaces.

The container comprises a discharge device 3 for discharging the cleaning fluid onto a floor and/or a surface to be cleaned. The discharge device 3 is embodied as a spray nozzle.

The container 1 also has a heating device 4 for the heating and/or temperature control of the cleaning fluid 2.

The heating device 4 comprises a first heating coil portion 5 for heating the cleaning fluid 2, which is located within a tank 6. The heating device 4 further comprises a second heating coil portion 7, which is received within a heat store 8.

The heat store 8 is held within the tank 6 and can thus deliver heat all around to the cleaning fluid 2. The tank 6 is preferably thermally insulated with respect to the atmosphere or surrounding environment.

The container 1 comprises a device 9 for filling the container 1. The container 1 further comprises a device 10 for coupling the container 1 to a cleaning apparatus.

Figure 2:
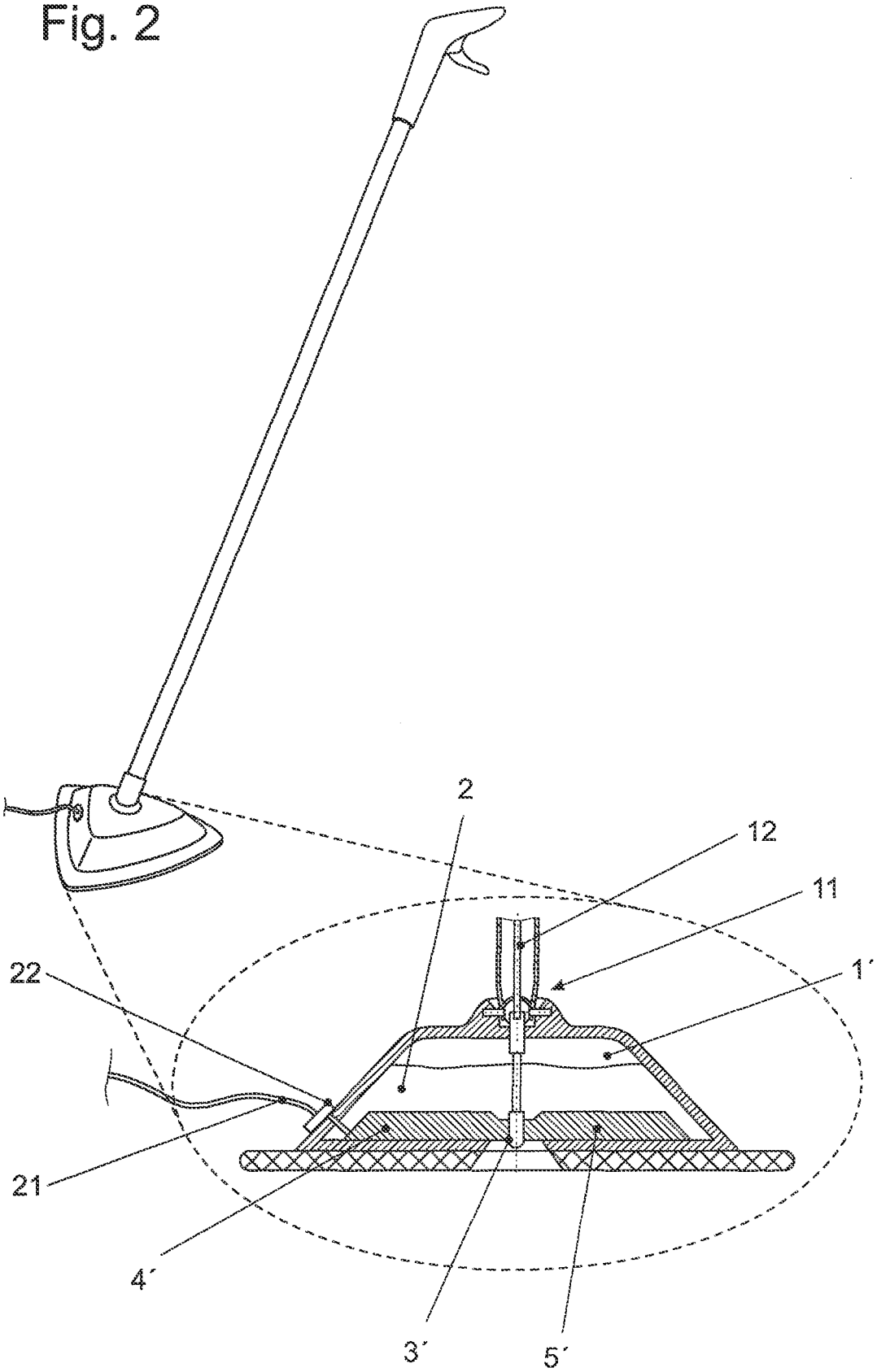
FIG. 2 shows a further exemplary embodiment of a cleaning apparatus, in which the heat store comprises phase change materials (PCMs)

FIG. 2 shows a cleaning apparatus for cleaning floors and/or surfaces, comprising a container 1' for holding a cleaning fluid 2, a discharge device 3' for discharging the cleaning fluid onto a floor and/or a surface to be cleaned, and a heating device 4' for the heating and/or temperature control of the cleaning fluid 2.

The heating device 4' is assigned a heat store 5', which holds the cleaning fluid 2 alone or jointly with the heating device 4' at a predefinable operating temperature.

The heating device 4' and also the heat store 5' comprise phase change materials (PCMs).

The discharge device 3' is embodied as a pump. The cleaning device comprises a removable shaft or handle 11. Cleaning fluid 2 can be pumped from the container 1' by a force transfer device 12.

Figure 3:
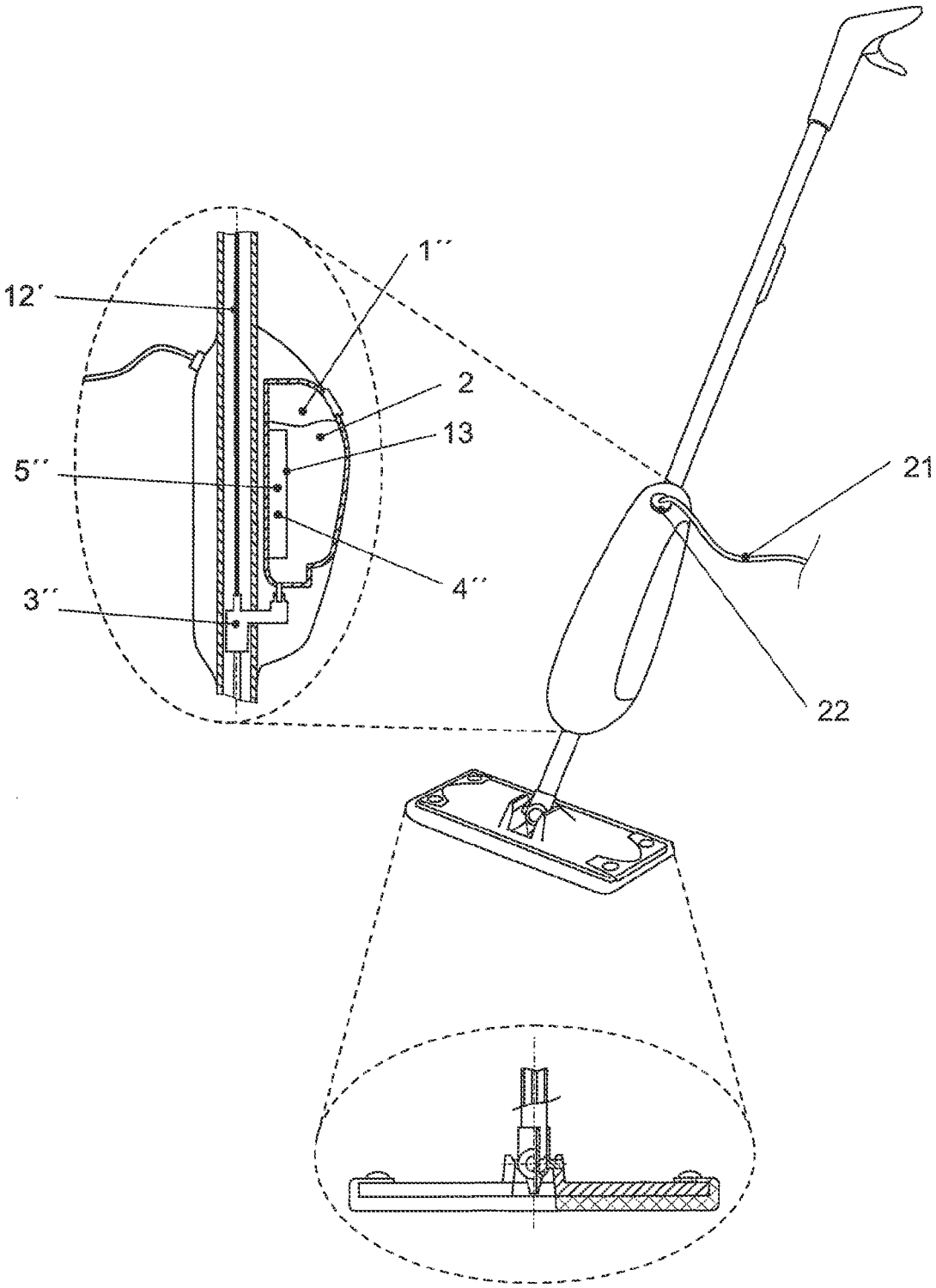
FIG. 3 shows a further exemplary embodiment of a cleaning apparatus, in which a battery is integrated into the container, wherein the container can be decoupled from the cleaning apparatus jointly with the battery.

FIG. 3 shows a further exemplary embodiment of a cleaning apparatus for cleaning floors and/or surfaces. The cleaning apparatus comprises a container 1" for holding a cleaning fluid 2, a discharge device 3" for discharging the cleaning fluid onto a floor and/or a surface to be cleaned, and a heating device 4" for the heating and/or temperature control of the cleaning fluid 2.

The heating device 4" can be assigned a heat store 5", which holds the cleaning fluid 2 alone or jointly with the heating device at a predefinable operating temperature.

The discharge device 3" is embodied as a pump. The pump is connected to a force transfer device 12'.

The heating device 4" heats the cleaning fluid 2 to an operating temperature that is greater than 10° C., but below 100° C. This is also true in respect of FIGS. 1 and 2.

The heating device 4" and/or the heat store 5" can be operated cordlessly. The heating device 4" can be operated by a battery 13.

The heat store 5" may comprise phase change materials, or what are known as PCMs. The container 1" can be removed from the cleaning apparatus. The heating device 4" and/or heat store 5" are integrated into the container 1".

The cleaning device is embodied as a mop.

FIG. 3 in this respect shows a cleaning apparatus, which shows a removable container 1", in which a battery 13 is received. Cordless operation is thus possible.

Figure 4:
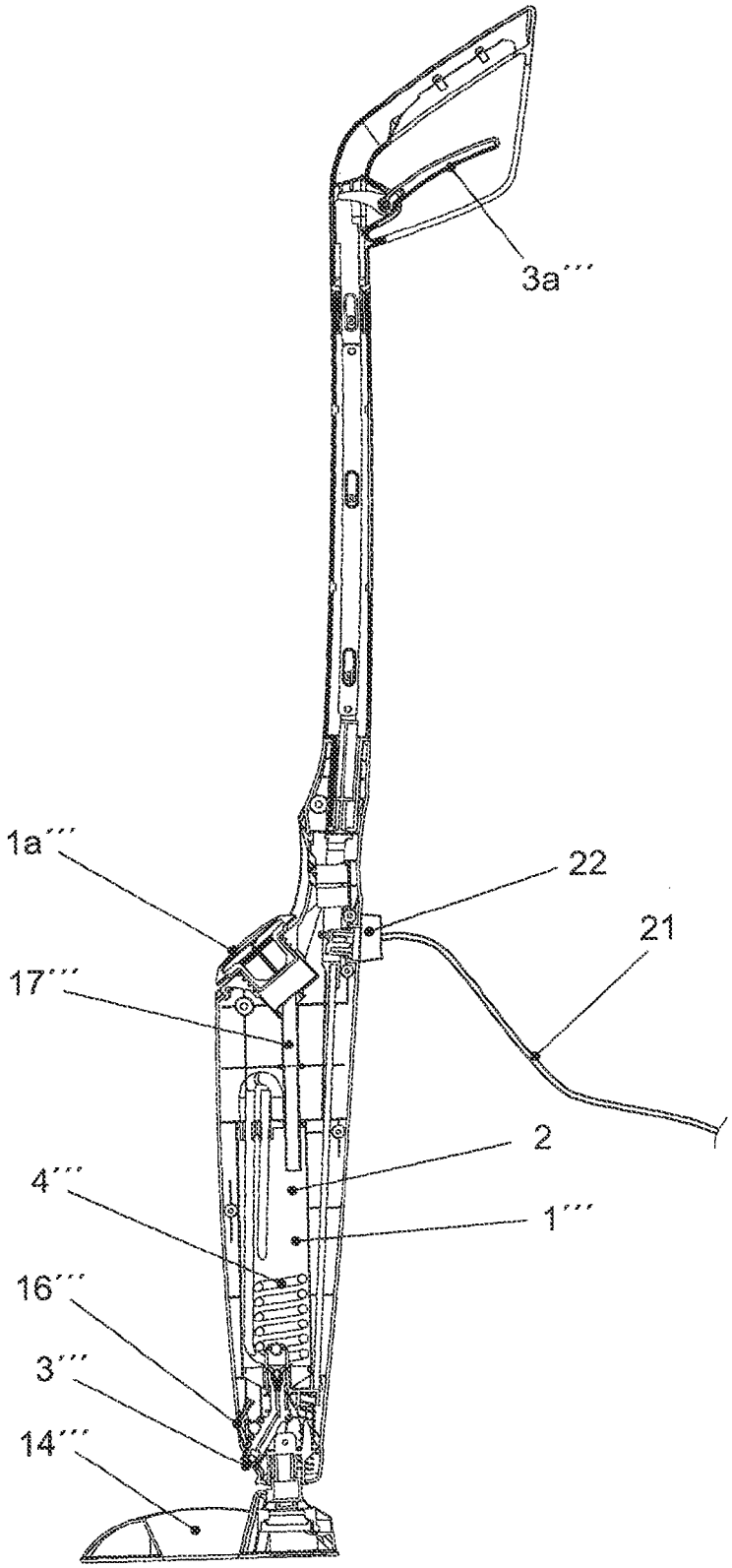
FIG. 4 shows a sectional illustration of a cleaning apparatus, in which a heating device in the form of an immersion heater with a heating coil is received in a fluid tank.
Figure 5:
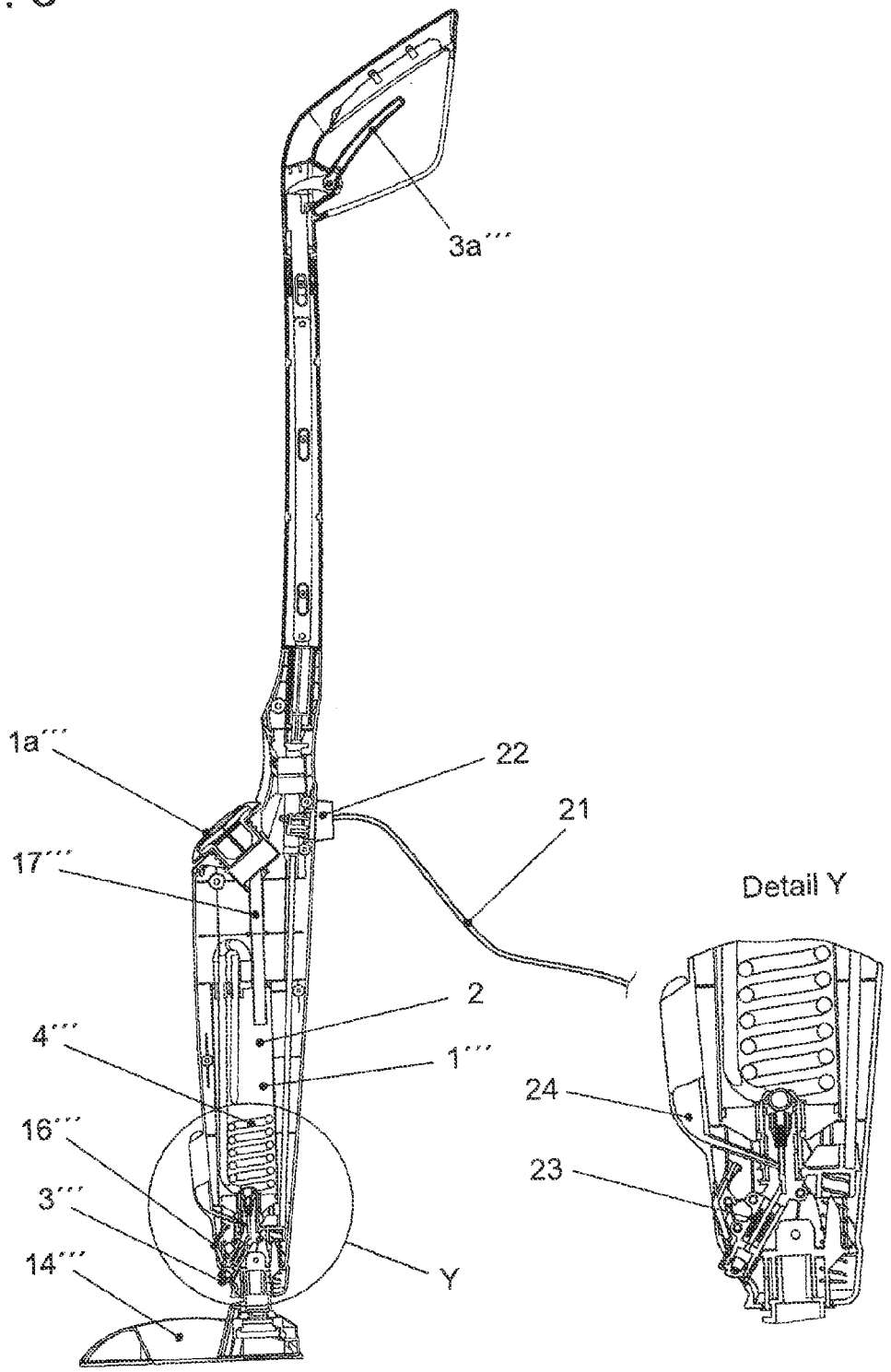
FIG. 5 shows a further sectional view of the cleaning apparatus according to FIG. 4, wherein the handle of the actuation device for the discharge device is pulled upwardly.
Figure 6:
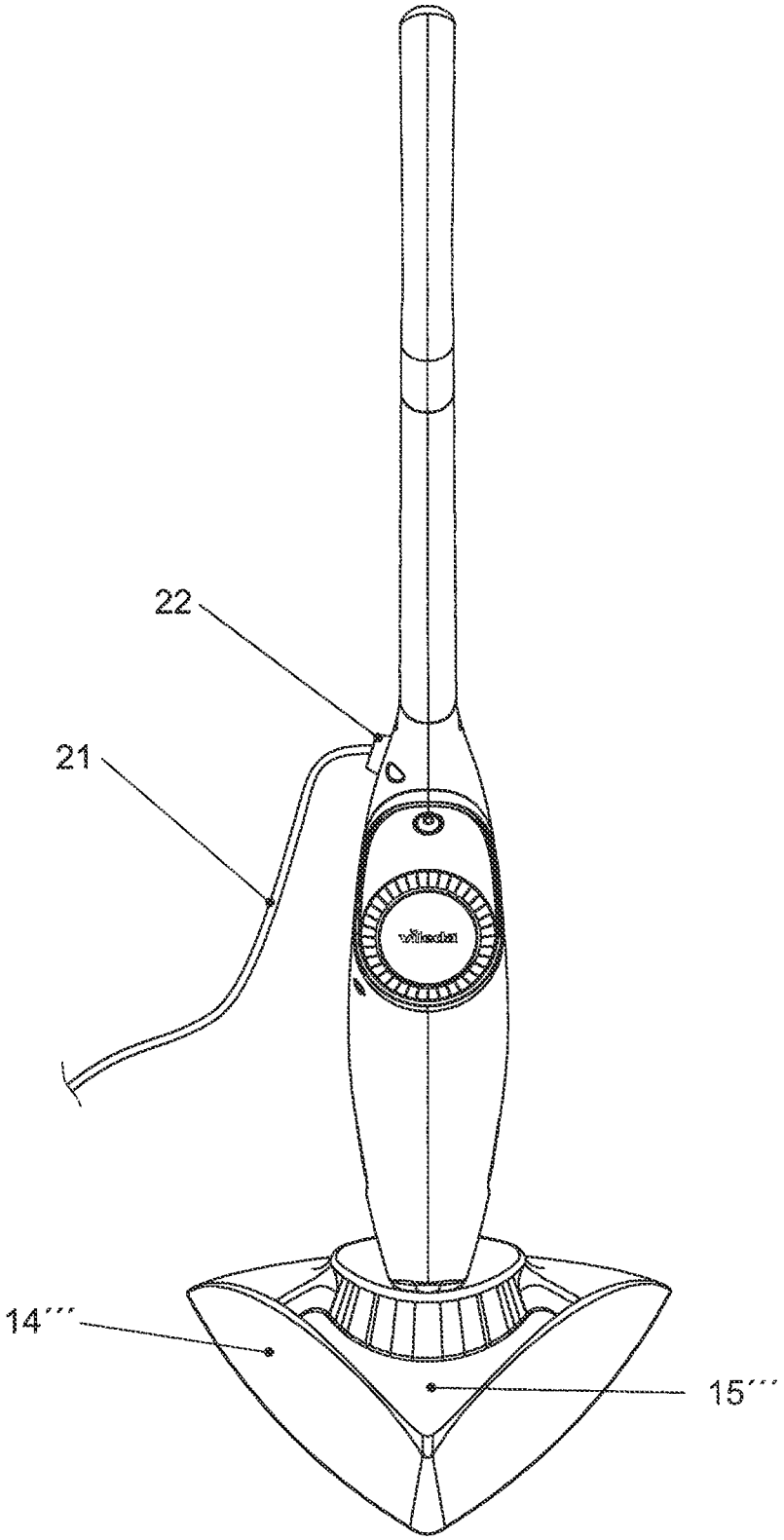
FIG. 6 shows a front view of the cleaning apparatus according to FIGS. 4 and 5, wherein it is illustrated that an opening is formed in the frame.

FIGS. 4 to 6 show a further cleaning apparatus for cleaning floors and/or surfaces.

This comprises a container 1''' for holding a cleaning fluid 2, a discharge device 3''' for discharging the cleaning fluid 2 onto a floor and/or a surface to be cleaned, and a heating device 4''' for the heating and/or temperature control and/or vaporization of the cleaning fluid 2. The cleaning apparatus can be operated cordlessly.

A power cable 21 can be connected via an adapter 22 to the cleaning apparatus and can be removed again for operation.

The container 1''' for holding the cleaning fluid 2 is formed as a thermally insulated fluid tank. The cleaning fluid 2 can be filled into this tank via a filling connection 1*a'''*.

FIG. 6 shows that the cleaning apparatus comprises a frame 14''', wherein an opening 15''' is provided in the frame 14''', through which opening the discharge device 3''' applies cleaning fluid 2 to the floor to be cleaned and/or the surface to be cleaned.

FIGS. 4 and 5 show that a display device 16''' is provided, which indicates that an operating temperature of the cleaning fluid 2 has been reached. The display device 16''' is formed as a whistle. The whistle is arranged in the vicinity of the discharge device 3''' in order to protect the operating individuals.

Furthermore, a fill level indicator 17''' is provided, which indicates the quantity of cleaning fluid 2 still available. The fill level indicator 17''' comprises a float and a flag, which can be seen from outside.

Furthermore, a reheater element 23 can be provided, which is assigned to the heating device 4''' or the discharge device 3''' so as to vaporize the cleaning fluid 2. Lastly, a metering device 24 can be provided, which adds a substance to the cleaning fluid 2. This is illustrated in FIG. 5.

The discharge device 3'' is operated by an actuation device, which comprises a handle 3*a*''. The handle 3*a*'' preferably cooperates with a rod, which actuates the discharge device 3''. In FIG. 5 the handle 3*a*'' is pulled upwardly.

Figure 7:
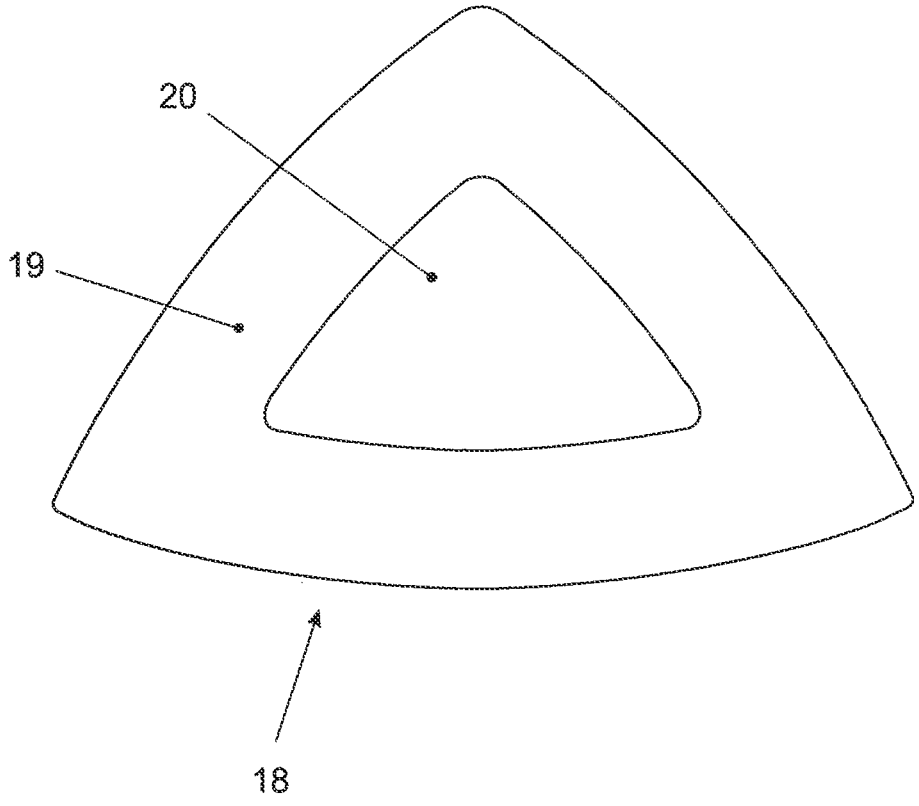
FIG. 7 shows a view of a cloth with a substantially triangular hole, wherein the cloth is formed in order to be carried by the frame according to FIG. 6.

FIG. 7 shows a cloth 18 for use on a cleaning apparatus according to FIGS. 4 to 6. The cloth comprises a planar main body 19, in which a hole 20 is formed. The cleaning fluid 2 can be applied through this hole 20 to a floor and/or a surface to be cleaned. The cloth 18 has an outer edge line, which substantially describes a triangle. The hole 20 is also substantially triangular.

Water, alcohol, oil, surfactant and/or a mixture of the aforementioned substances can be used as cleaning fluid 2.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A cleaning apparatus configured to clean a floor, surface, or both, the apparatus comprising:

a container configured to hold a cleaning fluid;

a discharge device configured to discharge the cleaning fluid onto a floor, a surface, or a floor and a surface to be cleaned; and a heating device configured for heating, temperature control, vaporization, or a combination thereof, of the cleaning fluid, wherein the heating device includes a heating element and a heat store, the heat store being distinct from the cleaning fluid and being configured to heat the cleaning fluid, wherein the heating device is configured to be coupled to an external power source for charging the heating device during a charging period, wherein the heating element is configured to generate heat during the charging period, thereby heating the heat store, wherein the heating device is configured to be decoupled from the external power source during a cleaning process such that the cleaning apparatus operates cordlessly during the cleaning process, wherein the heat store is configured to keep the cleaning fluid at a predefinable operating temperature during the cleaning process.

2. The apparatus of claim 1, wherein the heat store includes sugar.

3. The apparatus of claim 1, wherein the heating device is configured to heat the cleaning fluid to an operating temperature that is greater than 10° C., but below 100° C.

4. The apparatus of claim 1, wherein the heating device is configured to heat the cleaning fluid to an operating temperature that is greater than 100° C.

5. The apparatus of claim 1, wherein the heating element comprises an electrical resistance heater.

6. The apparatus of claim 1, wherein the heating device is configured to switch off automatically once a predefined operating temperature of the cleaning fluid has been reached.

7. The apparatus of claim 1, wherein at least one of the heating device and the heat store is configured to operate cordlessly.

8. The apparatus of claim 1, wherein the heating device can is configured to be operated by a battery.

9. The apparatus of claim 8, wherein the battery is configured to be charged by a charging apparatus which is held either in or on the cleaning apparatus, in or on an external charging station, or both.

10. The apparatus of claim 9, wherein at least two of the charging apparatus, the heating device, the heat store, and the cleaning fluid are configured to be acted on simultaneously with energy.

11. The apparatus of claim 1, wherein the heating device is configured to be operated by a mains voltage.

12. The apparatus of claim 1, wherein the heating device is configured to be operated by liquid fuel, solid fuel, gaseous fuel, or a mixture of two or more of any of these.

13. The apparatus of claim 1, wherein the heat store includes a phase change material.

14. The apparatus of claim 1, wherein the heat store comprises aluminum or tin.

15. The apparatus of claim 1, wherein the heat store is surrounded at least in part by the container.

16. The apparatus of claim 1, wherein the heat store is in contact with the container.

17. The apparatus of claim 1, wherein the container is configured to be removed from the cleaning apparatus.

18. The apparatus of claim 1, wherein at least one of the heating device and the heat store is removable from the apparatus.

19. The apparatus of claim 1, wherein at least one of the heating device and the heat store is integrated into the container.

20. The apparatus of claim 1, configured to be separable from a charging station.

21. The apparatus of claim 1, wherein the discharge device is insulated with respect to the surrounding environment.

22. The apparatus of claim 1, wherein the discharge device is heated.

23. The apparatus of claim 1, wherein the discharge device is mechanically operable, pneumatically operable, hydraulically operable, electrically operable, or two or more of these.

24. The apparatus of claim 1, wherein the container is-comprises a thermally insulated fluid tank.

25. The apparatus of claim 1, further comprising:

a frame including an opening provided in the frame, wherein the discharge device is configured to apply cleaning fluid to the floor, surface, or both, to be cleaned through the opening.

26. The apparatus of claim 25, further comprising:

a cloth including a planar main body, in which a hole is formed.

27. The apparatus of claim 1, further comprising:

a display device, wherein the display device is configured to indicate that an operating temperature of the cleaning fluid has been reached.

28. The apparatus of claim 27, wherein the display device comprises a whistle.

29. The apparatus of claim 28, wherein the whistle is arranged in the vicinity of the discharge device.

30. The apparatus of claim 1, further comprising:

a fill level indicator, wherein the fill level indicator is configured to indicate a quantity of cleaning fluid still available.

31. The apparatus of claim 1, further comprising:

a reheater element, wherein the reheater element is assigned to the heating device or the discharge device so as to vaporize the cleaning fluid.

32. The apparatus of claim 1, further comprising:

a metering device, wherein the metering device is configured to add a substance to the cleaning fluid.

33. The apparatus of claim 1, configured as a mop.

34. The apparatus of claim 1, wherein the heat store includes steel or zinc.

35. A cleaning apparatus configured to clean a floor, surface, or both, the apparatus comprising:

a container configured to hold a cleaning fluid;

a discharge device configured to discharge the cleaning fluid onto a floor, a surface, or a floor and a surface to be cleaned;

a heating device configured for heating, temperature control, vaporization, or a combination thereof, of the cleaning fluid; and a display device, wherein the heating device includes a heating element and a heat store, wherein the heating device is configured to be coupled to an external power source for charging the heating device during a charging period, wherein the heating element is configured to generate heat during the charging period, thereby heating the heat store, wherein the heating device is configured to be decoupled from the external power source during a cleaning process such that the cleaning apparatus operates cordlessly during the cleaning process, wherein the heat store is configured to keep the cleaning fluid at a predefinable operating temperature during the cleaning process, wherein the display device is configured to indicate that an operating temperature of the cleaning fluid has been reached, and wherein the display device comprises a whistle.

36. The apparatus of claim 35, wherein the whistle is arranged in the vicinity of the discharge device.

37. A cleaning apparatus configured to clean a floor, surface, or both, the apparatus comprising:

a container configured to hold a cleaning fluid;

a discharge device configured to discharge the cleaning fluid onto a floor, a surface, or a floor and a surface to be cleaned;

a heating device configured for heating, temperature control, vaporization, or a combination thereof, of the cleaning fluid; and a metering device, wherein the heating device includes a heating element and a heat store, wherein the heating device is configured to be coupled to an external power source for charging the heating device during a charging period, wherein the heating element is configured to generate heat during the charging period, thereby heating the heat store, wherein the heating device is configured to be decoupled from the external power source during a cleaning process such that the cleaning apparatus operates cordlessly during the cleaning process, wherein the heat store is configured to keep the cleaning fluid at a predefinable operating temperature during the cleaning process, and wherein the metering device is configured to add a substance to the cleaning fluid.

* * * * *